US009121335B2

(12) United States Patent
Quiring et al.

(10) Patent No.: US 9,121,335 B2
(45) Date of Patent: Sep. 1, 2015

(54) SYSTEM AND METHOD FOR AN ENGINE COMPRISING A LIQUID COOLING SYSTEM AND OIL SUPPLY

(75) Inventors: Stefan Quiring, Leverkusen (DE); Michael Tobergte, Cologne (DE); Hans Guenter Quix, Herzogenrath (DE); Kai Sebastian Kuhlbach, Bergisch Gladbach (DE); Bernd Steiner, Bergisch Gladbach (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 656 days.

(21) Appl. No.: 13/455,481

(22) Filed: Apr. 25, 2012

(65) Prior Publication Data

US 2012/0285401 A1 Nov. 15, 2012

(30) Foreign Application Priority Data

May 13, 2011 (DE) ..... 10 2011 075 780

(51) Int. Cl.
*F01P 7/14* (2006.01)

(52) U.S. Cl.
CPC ..... *F01P 7/14* (2013.01); *F01P 2007/146* (2013.01)

(58) Field of Classification Search
CPC ..... F01P 2007/146; F01P 7/12; F01P 7/16
USPC ..... 123/41.08, 196 R
See application file for complete search history.

(56) References Cited

U.S. PATENT DOCUMENTS

| | | | | | |
|---|---|---|---|---|---|
| 2,070,092 | A * | 2/1937 | Ramsaur | 123/196 AB |
| 3,877,455 | A * | 4/1975 | Goodwin | 123/198 D |
| 4,489,680 | A * | 12/1984 | Spokas et al. | 123/41.1 |
| 5,842,451 | A * | 12/1998 | von Eisebeck et al. | 123/196 R |
| 8,007,248 | B2 * | 8/2011 | Pryor et al. | 417/220 |
| 2008/0308353 | A1 * | 12/2008 | Aixala | 184/6.5 |

FOREIGN PATENT DOCUMENTS

| | | | |
|---|---|---|---|
| DE | 766237 | | 4/1952 |
| DE | 10239364 | A1 | 3/2004 |
| DE | 102004058864 | A1 | 6/2006 |
| DE | 102006019086 | A1 | 10/2007 |

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

An internal combustion engine is provided. The internal combustion engine includes an oil circuit and a pump in fluidic communication with a supply line and at least one lubricant receiving component and a liquid cooling system including a coolant circuit having an oil pressure actuated coolant valve and a coolant valve control line in fluidic communication with the pump and having a first configuration in which coolant may flow therethrough and a second configuration in which coolant is inhibited from flowing therethrough, the first and second configurations triggered in response to a change in oil pressure in the coolant valve control line.

17 Claims, 5 Drawing Sheets

SYSTEM AND METHOD FOR AN ENGINE COMPRISING A LIQUID COOLING SYSTEM AND OIL SUPPLY

CROSS REFERENCE TO RELATED APPLICATION

The present application claims the benefit of and priority to German Patent Application No. 102011075780.5 filed on May 13, 2011, entitled "Internal Combustion Engine Comprising a Liquid Cooling System and Oil Supply and Method for Operating Such an Internal Combustion Engine," the content of which is incorporated herein by reference for all purposes.

BACKGROUND/SUMMARY

Internal combustion engines may be used to provide motive power to a vehicle. Cooling may be provided to internal combustion engines, in principle, in the form of air cooling systems or liquid cooling systems. However, the addition or integration of various components into the engine may increase thermal loading on the engine. Specifically, it may be desirable to increase the compactness of the engine to decrease vehicle size and/or increase internal space in the vehicle via the integration of certain parts into others, such as the integration of the exhaust manifold into the cylinder head and/or cylinder block. This may in turn lead to increased thermal loading on the engine beyond acceptable levels. Therefore, it may be desirable to utilize liquid cooling systems as opposed to air cooling systems to remove heat from the engine due to the greater quantity of heat that may be removed via liquid cooling systems when compared to air cooling systems.

Liquid cooling systems may include at least one cooling jacket having cooling channels traversing a cylinder head. The coolant in the liquid cooling system may include water mixed with additives. The liquid cooling system may also include a pump for circulating coolant through the cooling jacket. The heat delivered to the coolant in the cooling jacket may be discharged from the cylinder head via discharge lines, which may be in fluidic communication with a heat exchanger.

To reduce the fuel consumption, rapid heating of the engine oil is expedient for the purpose of reducing friction in lubricated components, in particular after a cold start. Heating the engine oil reduces the viscosity of the oil and thus reduces friction in the lubricated components, in particular in bearings supplied with oil, such as crankshaft bearings.

Therefore, in some prior art engines oil is actively heated, for example, by an external heating device. Alternatively, the engine oil which has been heated during engine operation may be stored in an insulated tank, so that during start-up, oil which has been already heated is ready for use. Alternatively, a coolant-operated oil cooler may be diverted from its intended purpose in the warm-up phase and utilized for heating the oil. This, however, requires coolant which has already been heated. The engine oil may be heated in an accelerated manner via decreasing the amount of heat removed from the coolant in the cooling system during a warm-up phase.

To adjust the liquid cooling system automatically controlled temperature-dependent valves have been used. Specifically, the automatically controlled temperature-dependent valves may be used to decrease (e.g., inhibit) coolant flow during warm-up to increase the rate of heating of the engine. The automatically controlled valves are commonly thermostats that comprise a temperature-reactive element subjected to coolant in the cooling system. The automatically controlled valves are positioned at an inlet of the cooling jacket or upstream of the inlet in a supply line and may open or close based on the temperature of the coolant.

In some examples, the temperature-dependent valve may be positioned so that the coolant bypasses a heat exchanger when the valve is closed. In other examples, the temperature-dependent valve may be positioned in a supply line so that coolant flow through the cooling jacket is inhibited when the valve is closed. Opening the valve may enable coolant to flow through the heat exchanger and/or cooling jacket. In this way, the temperature of the engine may be adjusted by the temperature dependent valve. It will be appreciated that coolant flows through the valve even when it is closed to subject the temperature-reactive element to the coolant. It will be appreciated that when coolant flow is inhibited in the cooling jacket, the engine temperature increases more rapidly during warm-up. Specifically, the temperature-dependent valve is opened when the coolant temperature exceeds a specific threshold temperature. Likewise, the temperature-dependent valve is closed when the coolant temperature falls below the threshold temperature. Generally, the thermostat opens and closes repeatedly during the warm-up phase. Such a control would additionally promote the heating of the engine oil and further reduce the friction in lubricated components. In some examples, the temperature-dependent valve may be configured to flow coolant into a compensation tank when closed to inhibit coolant flow through the cooling jacket. Coolant valves of the aforementioned type are controlled by engine control systems which may include memory executable by a processor.

The German published patent application DE 10 2004 058 864 A1 discloses electronically controlled valves which may be arranged in connection with a cooling system. In addition to simple opening/closing valves with a vacuum cell or with a magnet as an actuator, a valve is disclosed which uses a redundant safeguard system. In this case, an electromagnet is actuated by the engine control system and, when current flows through a valve plate, lifts, i.e. opens, against a spring force, wherein a sufficiently high vacuum prevailing at high engine speeds also moves said plate. Additionally, a safety expansion element opens the valve, when a limit temperature is reached, in turn by lifting the valve plate.

The Inventors have recognized several drawbacks with the aforementioned cooling system. Firstly, the high cost of electrically controlled and actuated valves increase the cost of the engine. As a result, it may not be desirable to use the electrically controlled valves in mass produced engines where cost is a concern. Another drawback of the electrically controlled valve is the complexity of the control system and valve. Specifically, the electromagnet in the valve may fail and/or malfunction. As a result, thermal overloading of the internal combustion engine may occur, thereby degrading engine operation.

As such in one approach, an internal combustion engine is provided. The internal combustion engine includes an oil circuit and a pump in fluidic communication with a supply line and at least one lubricant receiving component and a liquid cooling system including a coolant circuit having an oil pressure actuated coolant valve and a coolant valve control line in fluidic communication with the pump and having a first configuration in which coolant may flow therethrough and a second configuration in which coolant is inhibited from flowing therethrough, the first and second configurations triggered in response to a change in oil pressure in the coolant valve control line.

In this way, the valve may be passively adjusted to alter the coolant flow in the liquid cooling system passively in response to changes in oil pressure. It will be appreciated that the cost of the oil pressure actuated coolant valve may be lower than electronically controlled valves due to the decreased complexity of the oil pressure actuated coolant valve. Moreover, the oil pressure actuated coolant valve may be more robust than electronically controlled valves due to the decreased complexity.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGS.

The invention is described in more detail hereinafter with reference to FIGS. 1-5.

DETAILED DESCRIPTION

An internal combustion engine having an oil pressure actuated coolant valve arranged in the coolant circuit thereof is described herein. It will be appreciated that the valve is hydraulically controllable via the engine oil. The oil pressure actuated coolant valve may be configured to adjust the flowrate of coolant in the coolant circuit. Specifically, the flow of coolant through a cooling jacket may be inhibited or enabled by the coolant valve. The oil pressure actuated coolant valve is controlled (e.g., switched) using a liquid pressure and specifically, oil pressure in a lubrication system. It will be appreciated that hydraulically controlled valves may be less expensive than electronically controlled valves. As a result, the cost of the engine may be reduced.

In this way, oil pressure is used to control the configuration of the oil pressure actuated coolant valve instead of coolant pressure and/or temperature. Moreover, the oil pressure actuated coolant valve is not electronically actuated but instead actuated via the oil pressure. As a result, the complexity of the oil pressure actuated coolant valve is reduced when compared to electronically actuated coolant valves, thereby reducing the cost of the valve as well as increasing the valve's reliability.

Additionally, benefits and synergistic effects may be realized by using oil pressure to control the shut-off element. For example, the oil pressure may be altered by an engine control system based on the loading and/or speed of the engine. Specifically, in some examples the oil pressure may be increased as the load and/or engine speed increases and the oil pressure may be decreased as the oil pressure decreases. Such an alteration of the oil pressure therefore leads to an adjustment of the configuration of the oil pressure actuated coolant valve. As previously discussed, the oil pressure actuated coolant valve is arranged in the coolant circuit and the configuration of the oil pressure actuated coolant valve is adjusted in response to a change in the oil pressure. As a result, the flow of coolant in the coolant circuit may be altered based on the oil pressure. Such an adjustment of the flow of coolant may be desired in the event of a changing engine load and/or rotational engine speed. Thus, the adjustment of the coolant flow triggered by a change in oil pressure, provides additional benefits. Furthermore, it will be appreciated the oil pressure actuated coolant valve may be easily retrofitted into an internal combustion engine, due to the valve's design. As a result, the valve's applicability may be increased.

Figure 1:
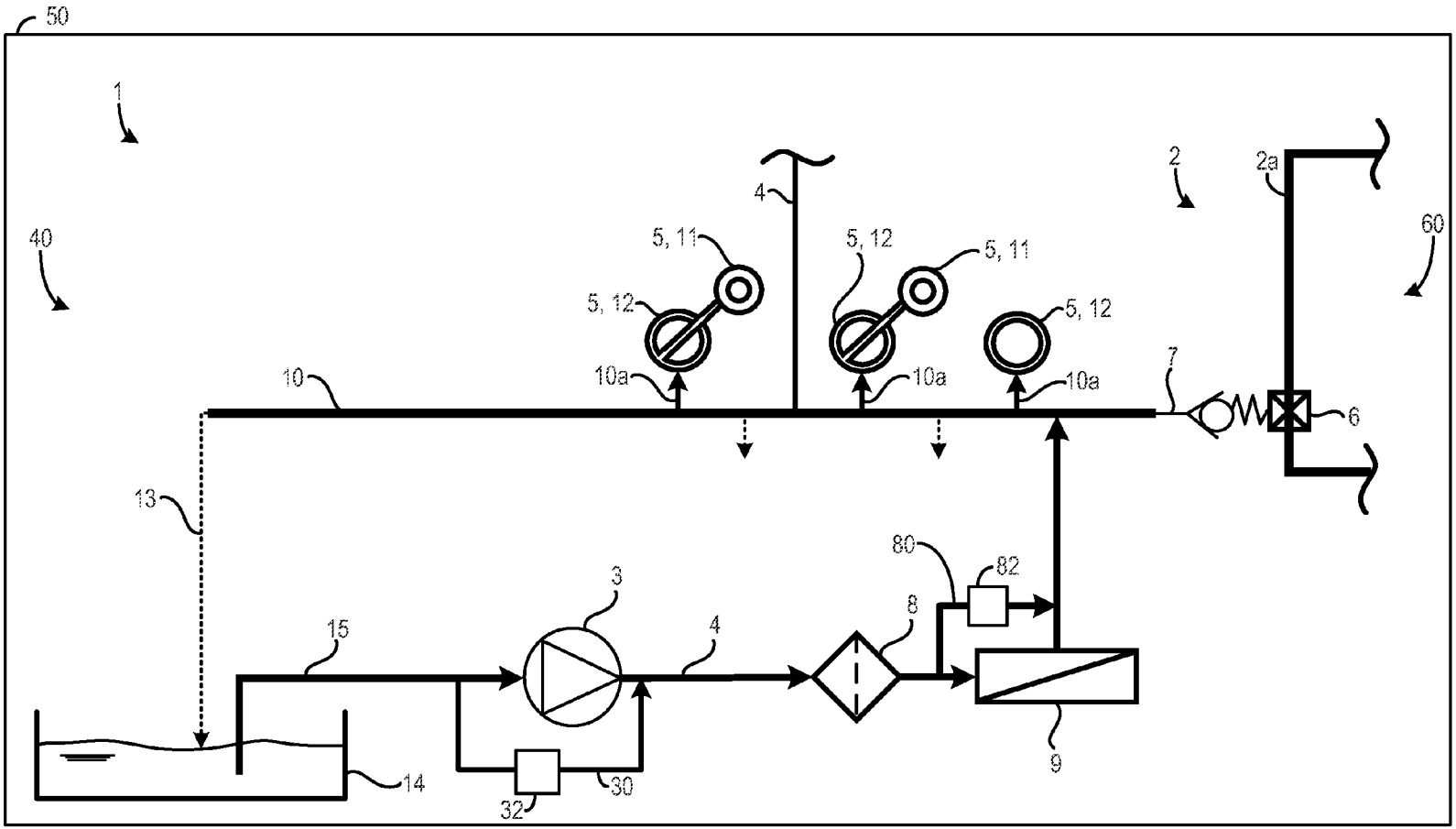
FIG. 1 shows schematically the oil circuit of a first embodiment of the internal combustion engine together with a portion of the coolant circuit.

FIG. 1 shows schematically a first embodiment of a lubrication system 40 including and oil circuit 1. The lubrication system 40 is included in an internal combustion engine 50. A line 2*a* and a coolant circuit 2 are also depicted. The coolant circuit 2 including coolant line 2*a* is also included in the engine 50.

For flowing engine oil through the oil circuit 1 a pump 3 is provided. In other words, the pump 3 provides head pressure to the oil circuit 1, when desired. A suction line 15 opens into an oil sump 14. The suction line 15 is in fluidic communication with the pump 3. In some examples, the suction line 15 may be included in the pump 3. Thus, the suction line supplies the pump 3 with engine oil from the oil sump 14. The oil sump 14 collects and stores engine oil. In this way, the pump 3 is supplied with engine oil originating from the oil sump via a suction line which leads from the oil sump 14 to the pump 3. The suction line 15 may be sized to provide a desired amount of oil to the pump 3. Moreover, the pump 3 may be sized to provide a desired amount of volumetric displacement and therefore the oil pressure to the lubrication system 40 and in particular the main oil gallery 10.

The pump 3 is configured to flow oil via the supply line 4 to lubricant receiving components 5 included in the oil circuit 1. The lubricant receiving components 5 may include a crankshaft 324, shown in FIG. 3, and a camshaft, and/or bearings associated with the crankshaft and/or camshaft. The lubricant receiving components receive engine oil for fulfilling and maintaining their function. Additionally, lubricant receiving components may include the bearings of a piston rod or an optionally provided balancing shaft in the engine 50. The lubricant receiving components may also include a nozzle for spraying oil onto the base of a piston for cooling, thereby wetting the bottom of the piston. The nozzle may be included in an oil spray cooling system. The lubricant receiving components may further include a hydraulically actuatable camshaft adjuster or other valve train components, for example for hydraulic valve play compensation.

In the depicted embodiment, a filter 8 is positioned downstream of the pump 3 in the supply line 4. The filter 8 and supply line 4 are included in the oil circuit 1. The filter 8 is configured to remove particulates from the oil flowing therethrough. Specifically, the filter is configured to retain particles, in particular solid particles due to the abrasion, in order to protect the components provided downstream in the oil circuit 1 (e.g., the lubricant receiving components) from damage.

For adjusting the oil pressure in the oil circuit 1, an oil pump bypass line 30 may be provided. The oil pump bypass line 30 is depicted as branching off from the supply line 4 downstream of the pump 3 and the suction line 15 upstream of the pump 3. Specifically, the oil pump bypass line 30 may be in fluidic communication with oil lines directly upstream and downstream of the pump 3. Directly upstream and downstream of the pump means that there are not intervening component positioned therebetween. A pressure relief valve 32 may be arranged in the bypass line 30. The pressure relief valve 32 may be configured to open (e.g., enable oil to flow therethrough) when the oil in the bypass line exceeds a predetermined oil pressure. In some examples, the pressure relief valve may be a suitable valve such as a check valve or may be an electronically actuated valve. However, it will be appreciated that the oil pump bypass line 30 and pressure relief valve 32 may not be included in the oil circuit 1, in other embodiments.

A coolant-operated oil cooler 9 is positioned downstream of the filter 8 and the pump 3 in the supply line 4. However, in some examples, the oil cooler 9 may be positioned upstream of the filter 8 in the supply line 4. The oil cooler 9 may remove heat from the oil during operation to reduce the likelihood of the oil overheating which may influence the oil's properties, such as the oils ability to provide a desirable amount of lubrication. Overheating may also cause deterioration of the oil. During a warm-up phase, the oil cooler 9 may be bypassed via a bypass line 80 including a bypass valve 82 or otherwise inhibited from removing heat from the oil. The oil cooler 9 may be deactivated during a warm-up phase. A warm-up phase may be defined as a period of engine operation when the engine is below a predetermined threshold temperature and performing combustion.

The filter 8 and the oil cooler 9 are not considered lubricant receiving components 5. More specifically, said components (i.e., the filter and the oil cooler) of the oil circuit are supplied with engine oil and/or engine oil flows through said components. In principle, however, an oil circuit only involves the use of these components, whereas lubricant receiving components receive oil from the oil circuit.

The supply line 4 discharges downstream into a main oil gallery 10. A main supply channel may be included in the main oil gallery 10. The main supply channel may be oriented along the longitudinal axis of a crankshaft 324, shown in FIG. 3. The main supply channel may be arranged above or below the crankshaft in the crank housing, or incorporated in the crankshaft, in some embodiments.

Thus, the supply line 4 is in fluidic communication with the main oil gallery 10 and includes an outlet opening into the main oil gallery. Oil channels 10*a* flow oil to the main bearings 12 of the crankshaft and to the piston bearings 11 from the main oil gallery 10. Thus, the main bearings 12 and the piston bearings 11 are in fluidic communication with the main oil gallery 10. The main bearings 12 may be supplied oil on a side positioned adjacent to a crankshaft, in some embodiments. As a result, the length of the oil lines leading to the piston bearings 11 may be reduced. The main oil gallery 10 may be positioned in a cylinder block 300, discussed in greater detail herein with regard to FIG. 3. From the main oil gallery 10 the supply line 4 leads to a cylinder head 302 and additional oil receiving components (not shown). Return lines 13, which may be driven by gravity, flow engine oil back into the oil sump 14, branch off from the main oil gallery 10. The return lines 13 may extend through the cylinder block 300, in some embodiments.

The oil circuit 1 may also provide oil to additional components, such as a camshaft. The camshaft may be mounted in a two-part camshaft holder. Also, the camshaft holder may be supplied with engine oil via a supply channel branching off from the main oil gallery 10. Alternatively, a supply line may be provided which leads directly from the pump 3 into the cylinder head 302, shown in FIG. 3, supplies the camshaft holder with engine oil and optionally flows oil downstream to the main oil gallery 10.

It will be appreciated that the oil circuit 1 may flow oil through a cylinder block 300 and subsequently a cylinder head 302, shown in FIG. 3. Specifically, the supply line 4 may traverse both the cylinder block 300 and the cylinder head 302. However, in other embodiments the oil circuit 1 may first flow oil through the cylinder head 302 and then the cylinder block 300. It will be appreciated that the oil is heated when it flows through the cylinder block 300.

Figure 3:
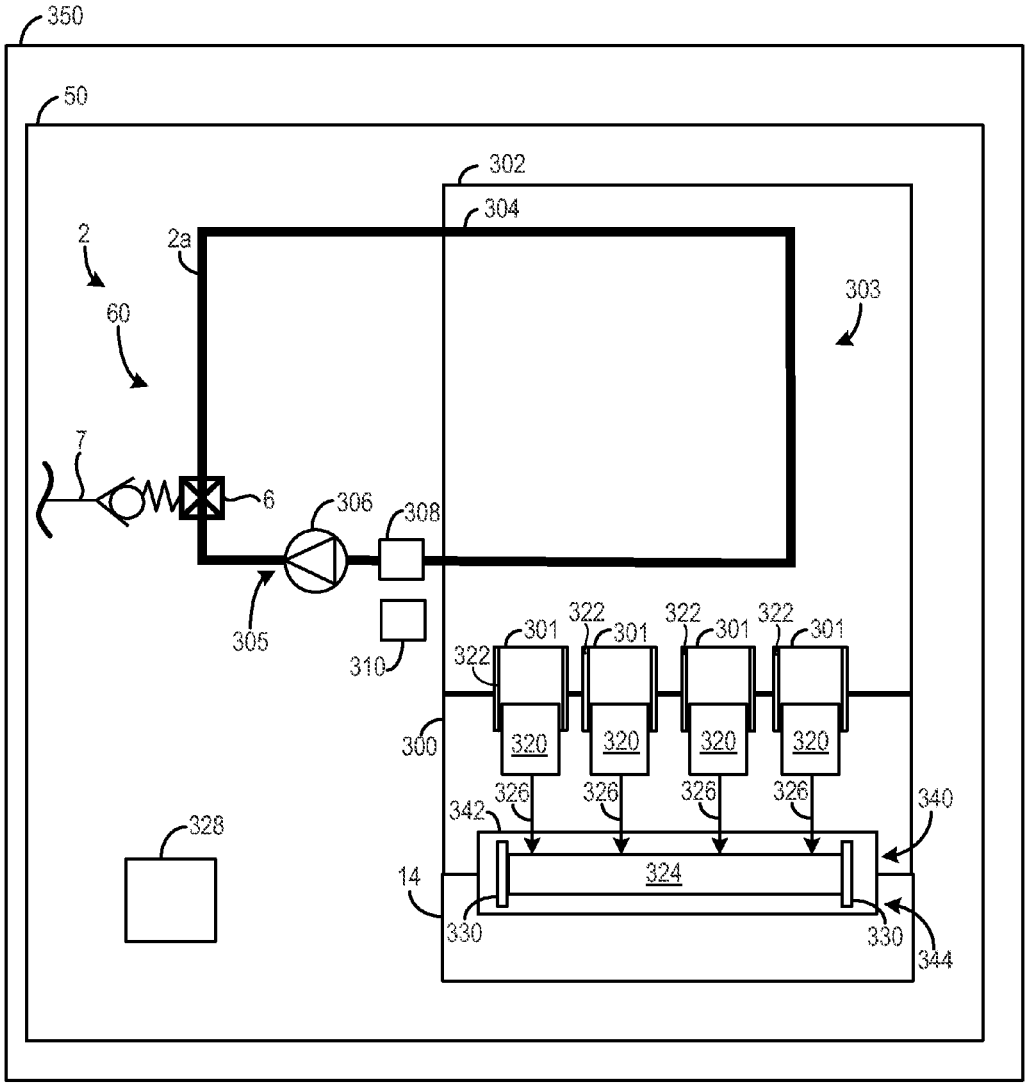
FIG. 3 shows a schematic depiction of the internal combustion engine shown in FIGS. 1 and 2.

In some embodiments it may be beneficial, in order to achieve as rapid heating as possible of the oil, that the supply line 4 of the oil circuit 1 initially passes through the cylinder head 302, shown in FIG. 3. In particular, at very low external temperatures, the circumstance where the cylinder head heats up more rapidly due to the combustion processes taking place in the cylinders, thereby providing rapid oil heating. This effect is even more apparent if further technical features are implemented, for example the integration of the manifold in the cylinder head.

A liquid cooling system 60 is provided in the engine 50. The liquid cooling system 60 includes a coolant circuit 2. An oil pressure actuated coolant valve 6 is arranged in a coolant line 2*a* of the coolant circuit 2. Therefore, the oil pressure actuated coolant valve 6 is hydraulically controlled. The oil pressure actuated coolant valve 6 may be a shut-off valve, in some examples. The oil pressure actuated coolant valve 6 may be arranged in a first configuration and a second configuration. Thus, the coolant valve 6 may be adjusted from the first configuration to the second configuration and vice-versa. In the first configuration the oil pressure actuated coolant valve 6 may allow coolant to flow through coolant line 2*a*. Specifically, in some examples in the first configuration coolant may be enabled to flow through the oil pressure actuated coolant valve 6. In the second configuration the oil pressure actuated coolant valve 6 may inhibit coolant flow through coolant line 2*a*. It will be appreciated that in some examples, a small amount of coolant may leak or otherwise flow through the valve due to the characteristics of components in the coolant valve in the second configuration. The first configuration may be referred to as an open position and the second configuration may be referred to as a closed position. However, in other embodiments the second configuration may be the open position and the first configuration may be the closed position.

A coolant valve control line 7 is also provided in the liquid cooling system 60 and therefore the engine 50. As depicted, the coolant valve control line 7 includes an inlet 70 positioned downstream of the filter 8 and the oil cooler 9. However, in other embodiments the inlet 70 may be positioned upstream of the filter 8 and/or the oil cooler 9 and downstream of the pump 3. It may be desirable to arrange the coolant valve control line downstream of the filter 8 if the filter is contaminated. Additionally, the coolant valve control line 7 is depicted as branching off the main oil gallery 10. However, other positions of the coolant valve control line 7 have been contemplated.

The coolant valve control line 7 may provide hydraulic control to the coolant valve 6. That is to say that the configuration of the coolant valve 6 may be adjusted in response to a change in oil pressure in the coolant valve control line 7. Methods for adjusting the coolant valve 6 are discussed in greater detail herein with regard to FIGS. 4 and 5.

Figure 2:
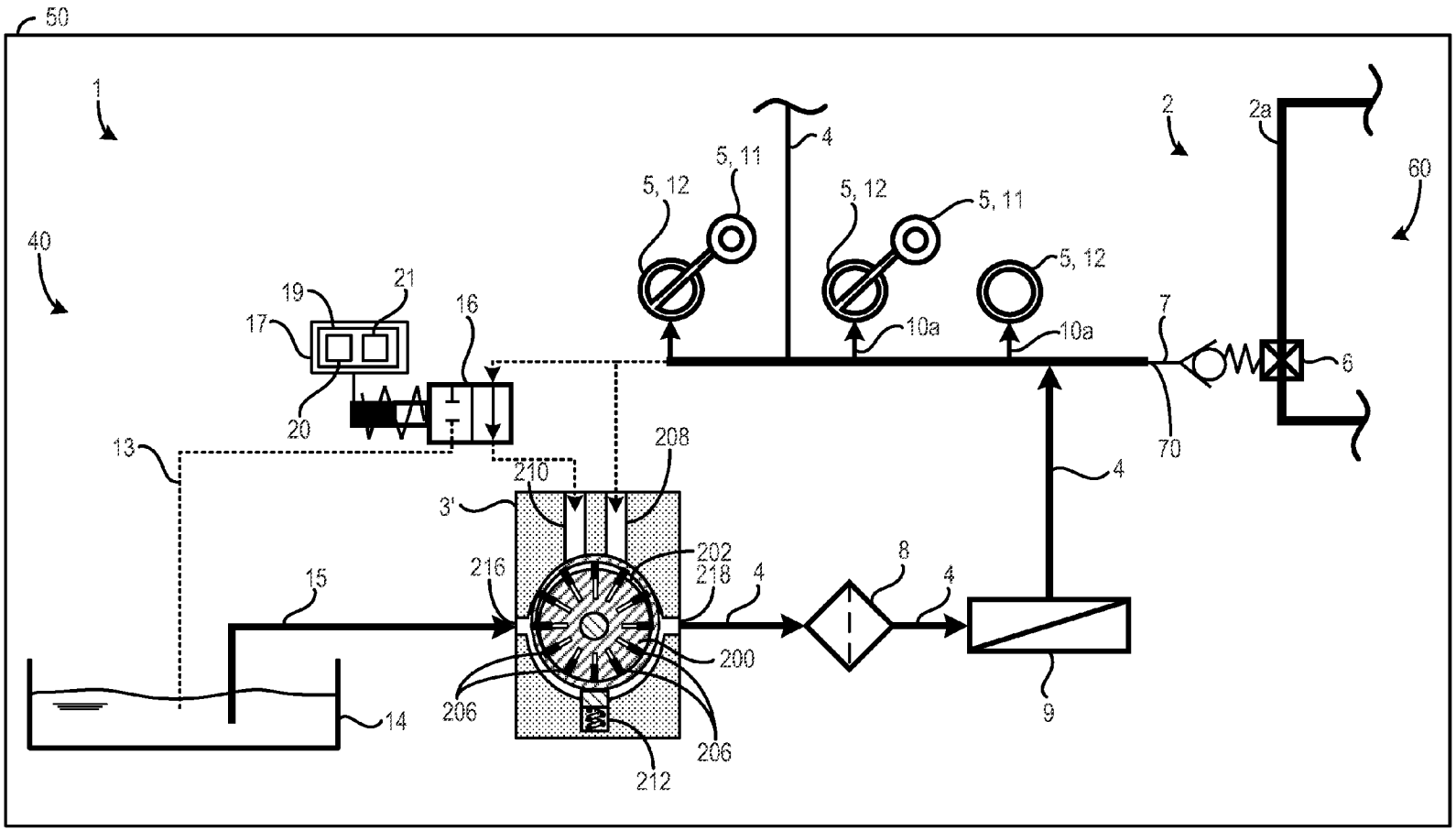
FIG. 2 shows schematically the oil circuit of a second embodiment of the internal combustion engine together with a portion of the coolant circuit.

FIG. 2 shows schematically a second embodiment of the oil circuit 1 included in the internal combustion engine 50. The coolant circuit 2 and coolant line 2*a* are also depicted in FIG. 2. FIG. 2 includes many of the components depicted in FIG. 1. Therefore, similar components are labeled accordingly. Only the differences from the embodiment shown in FIG. 1 are described below with regard to FIG. 2.

The oil circuit 1 shown in FIG. 2 includes a vane cell pump 3' for supplying the oil to downstream components, such as the lubricant receiving components 10. The vane cell pump 3' includes a rotor 200 configured to circulate within a hollow cavity 202. Thus, the hollow cavity 202 may at least partially enclose the rotor 200. The rotor 200 and/or the hollow cavity 202 may be cylindrical. Furthermore, the hollow cavity 202 may act as a stator. In the rotor 200, a plurality of radially arranged sliders 206 (e.g., vanes) may be displaceably arranged in a translatory manner. The sliders may subdivide the space between the hollow cavity 202 and rotor 200 into a plurality of chambers. The eccentricity of the rotational axis of the rotor 200 is variable. Thus, the rotor 200 may be arranged eccentrically to the hollow cavity 202. In this way, the volumetric capacity of the pump 3' may be altered. An increase in volumetric capacity leads to an increased oil pressure at the pump outlet 218. The vane cell pump also includes an inlet 216.

The vane cell pump 3' may provide continuous pressure to the oil circuit 1, when compared to a displacement pump which provides intermittent increases in pressure to the oil circuit 1. The volumetric capacity of the vane cell pump 3' may be altered by adjusting the eccentricity of the rotor 200. An increase in volumetric capacity of the pump 3' may lead to an increase in oil pressure at the pump outlet. An adjustment of the eccentricity between the rotor 200 and the hollow cavity 202 may be implemented via an electrically controllable pump valve 16. The vane cell pump 3' includes an open pressure line 208. Oil may flow into the open pressure line 208 from the main oil gallery 10 uninhibited. The vane cell pump 3' further includes a second pressure line 210. A spring 212 may also be included in the vane cell pump 3'. The spring 212 may provide a resistive force to the pressure exerted on the rotor via the fluid flowing through the first and/or second pressure lines (208 and 210, respectively). In some examples, the second pressure line may be constantly open. However, in other examples, the second pressure line may be intermittently open. The pump valve 16 is configured to trigger adjustment of the volumetric output in the vane cell pump 3'. Specifically, the pump valve 16 is configured to open or block the second pressure line 210 to the vane cell pump 3' and is actuated by the engine control system 17. However, it will be appreciated that the pump valve 16 may trigger adjustment in the pump through other suitable techniques, in other embodiments. The engine control system 17 includes a controller 19 comprising memory 20 executable via a processor 21. The surface subjected to oil in the vane cell pump 3' and/or oil pressure is increased and/or reduced by actuating the valve 16, so that a greater and/or smaller force resulting from the oil pressure counteracts the spring force and varies the eccentricity of the pump.

FIG. 3 shows another schematic depiction of the internal combustion engine 50. It will be appreciated that the components in FIGS. 1 and 2 may also be included in the internal combustion engine 50, shown in FIG. 2. The internal combustion engine 50 may provide propulsion to a motor vehicle 350. The term "internal combustion engine" incorporates diesel engines and spark ignition engines but also hybrid internal combustion engines, i.e. internal combustion engines which are operated by a hybrid combustion process.

The internal combustion engine 50 may include a cylinder block 300 and at least one cylinder head 302, the cylinder block and the cylinder head may be connected to one another to form the individual cylinders 301. The cylinders may be referred to as combustion chambers.

The liquid cooling system 60 including the coolant circuit 2 is included in the engine 50 shown in FIG. 3. As illustrated, the coolant line 2*a* is in fluidic communication with a cylinder head cooling jacket 303 including at least one coolant passage 304 traversing the cylinder head 302. Thus, the coolant jacket 303 may be integrated into the cylinder head 302. The at least one coolant passage may receive coolant from an outlet 305 of a pump 306 and discharge coolant to an inlet of the pump 306. In this way, coolant may be circulated through the cylinder head 302. It will be appreciated that in other embodiments, the cooling jacket 303 may include additional coolant passages which may flow coolant in series and/or parallel through the cylinder head 302. Further in some examples, the cylinder block 300 may also include a cooling jacket. The cylinder block cooling jacket may be in fluidic communication with the cylinder head cooling jacket 303, in some examples. Further in some examples, the cooling jacket 303 may be conceptually divided into supply lines (e.g., coolant inlet housing) and/or discharge lines (e.g., coolant outlet housing). A heat exchanger 308 may be positioned in the coolant line 2*a* upstream of the oil pressure actuated coolant valve 6. The heat exchanger 308 may be configured to remove heat from the coolant. In some examples, a fan 310 directed at the heat exchanger 308 may be provided in the engine 50 to increase heat transfer to the air surrounding the heat exchanger. However, in other embodiments the heat exchanger 308 may rely on the airflow generated through the motion of the vehicle 350 for heat transfer. Further in some embodiments, the coolant line 2*a* may be a line bypassing the heat exchanger 308. Therefore, when the coolant valve is opened coolant may flow around the heat exchanger thereby increasing the temperature of the cylinder head.

Additionally, a second heat exchanger may be provided in the liquid cooling system 60, in some examples. The second heat exchanger may be configured to provide heated air to a passenger compartment in the vehicle 350. Specifically, coolant may be flowed in series or parallel to the second heat exchanger. Therefore, the cooling system may include branch lines in such an example. In this way, additional heat may be removed from the coolant in the cooling system. Additionally, the coolant circuit 2 may further include lines and/or circuits, for example a line which guides the coolant through a compensation tank which serves to store and stabilize the coolant, which may be for ventilation.

It will be appreciated that the liquid cooling system 60 may be adjusted to provide a desired amount of cooling to the engine 50 during certain operating conditions. For example, during a warm-up phase when the internal combustion engine 50 is below a predetermined threshold temperature, the amount of coolant flowing through the liquid cooling system 60 may be decreased and in some embodiments inhibited to decrease the duration of the warm-up phase.

The cylinders 301 (e.g., cylinder bores) may each receive pistons 320. Each of the cylinders 301 may also includes cylinder liners 322. Each piston in the internal combustion engine 50 is guided in an axially movable manner in the cylinder. As previously discussed, the cylinder may include portions of the cylinder block 300 and the cylinder head 302. Each piston's base forms here a part of the combustion chamber internal wall and, together with the piston rings, seals the combustion chamber against the cylinder block 300 and/or the crank housing, so that substantially no combustion gases and/or no combustion air enters the crank housing and no oil reaches the combustion chamber.

The pistons 320 may transmit the gas forces generated during combustion to a crankshaft 324. To this end, the pistons 320 are each connected in an articulated manner via a piston rod to a connecting rod, which in turn is rotatably mounted on the crankshaft 324. Arrows 326 denote the aforementioned linkage.

The cylinder block 300 may receive at least a portion of the crankshaft 324. Additionally, the crankshaft 324 may be mounted in the crank housing. Furthermore, the crankshaft 324 may receive the connecting rod forces generated by gas forces from the combustion of fuel in the combustion chambers and the mass forces due to the unequal movement of the drive parts. In this case, the oscillating reciprocal movement of the pistons 320 is transformed into rotational movement of the crankshaft 324. In some examples, the crankshaft 324 transmits the torque to a drive train (not shown). The crankshaft 324 may be used to drive secondary units, such as the oil pump 3, shown in FIG. 3, and a generator 328 or may drive a camshaft and thus actuates a valve train. Therefore, a portion of the rotational energy of the crankshaft may be transferred to the secondary units and/or the camshaft. The camshaft may be at the top in the cylinder head.

For receiving and mounting the crankshaft, at least two main bearings 330 are provided in the engine. The two main bearing 330 may be included in the bearings 12, shown in FIGS. 1 and 2. The main bearings 330 may be designed in two parts and in each case comprise a bearing saddle and a bearing cap which may be connected to the bearing saddle. The crankshaft may be mounted in the region of the crankshaft pins, which are arranged and spaced apart from one another along the crankshaft axis, and may be configured as thickened shaft shoulders. In this case, the bearing cap and bearing saddle may be configured as separate components or integrally with the crank housing, i.e. the crank housing halves. Bearing shells may be arranged as intermediate elements between the crankshaft and the bearings.

In the mounted state, each bearing saddle may be connected to the corresponding bearing cap. In each case, a bearing saddle and a bearing cap, optionally in cooperation with bearing shells as intermediate elements, may form a bore for receiving a crankshaft pin. The bores may be supplied with engine oil so that between the inner surface of each bore and the associated crankshaft pin when the crankshaft rotates, which may be similar to a plain bearing, a load-bearing film of oil is formed.

Furthermore, it will be appreciated that the cylinder block 300 may include an upper portion 340 of a crankcase housing 342. Additionally, the cylinder block 300 may be coupled (e.g., connected) to the oil sump 14 shown in FIGS. 1 and 2, which may include a lower portion 344 of the crankcase housing 342. As previously discussed, the oil sump 14 is configured to collect and store the engine oil. The oil sump 14 may be spaced away from the cylinder head 302, shown in FIGS. 1 and 2. The upper portion of the crank housing may include a flange surface for receiving the oil sump and specifically the lower portion of the crank housing. For sealing the oil sump and/or the crank housing relative to the surroundings a seal is provided in and/or on the flange surface. The connection is made, for example, by a screw connection. The oil sump 14, shown in FIG. 1, collects and stores engine oil and is part of the oil circuit 1. Moreover, the oil sump 14 may also act as a heat exchanger for reducing the oil temperature in an internal combustion engine 50. The oil located in the oil sump may be cooled by air flow passing outside the sump, due to heat conduction and convection.

Figure 4:
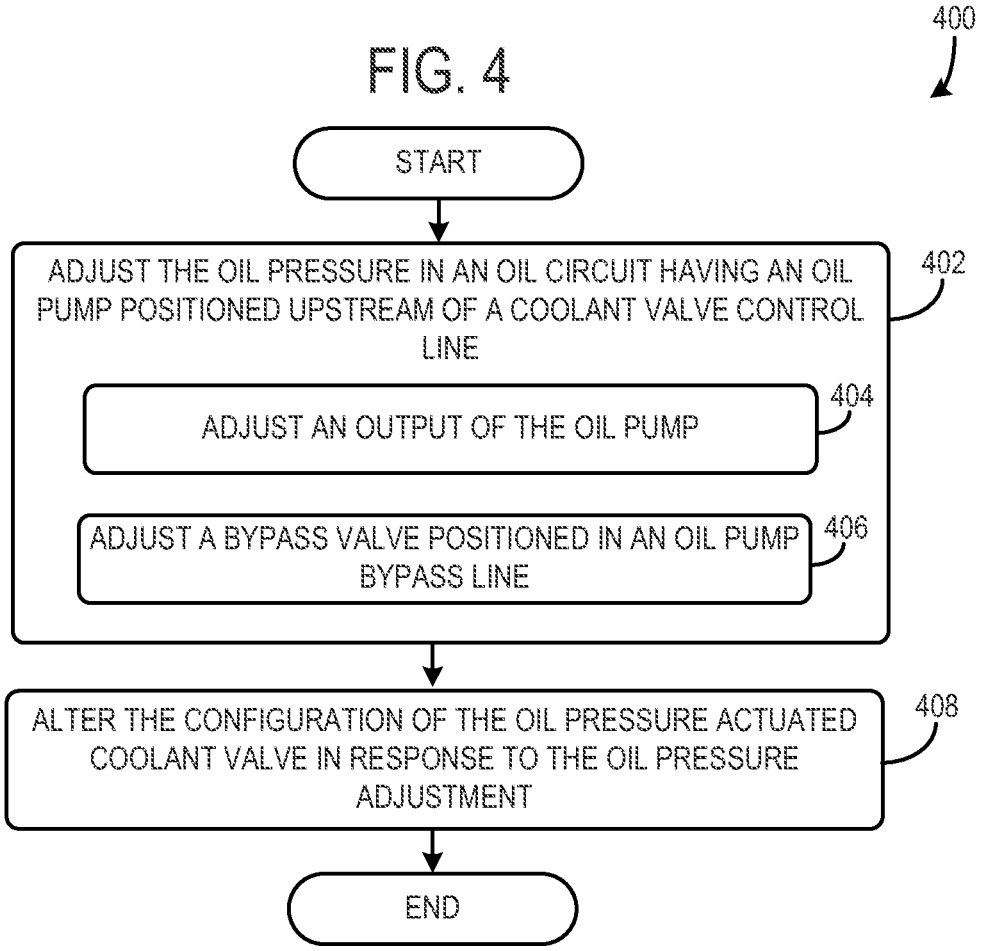
FIG. 4 shows a method for operation of an internal combustion engine.

FIG. 4 shows a method 400 for operation of an engine. Method 400 may be implemented to operate the engine 50 described above with regard to FIGS. 1-3 or may be implemented to operate another suitable engine.

At 402 the method includes adjusting the oil pressure in an oil circuit having an oil pump positioned upstream of a coolant valve control line. Adjusting the oil pressure in the oil circuit may include at 404 adjusting an output (e.g., volumetric output) of the pump and/or at 406 adjusting a bypass valve positioned in an oil pump bypass line. Next at 408 the method includes altering the configuration of the oil pressure actuated coolant valve in response to the oil pressure adjustment.

Figure 5:
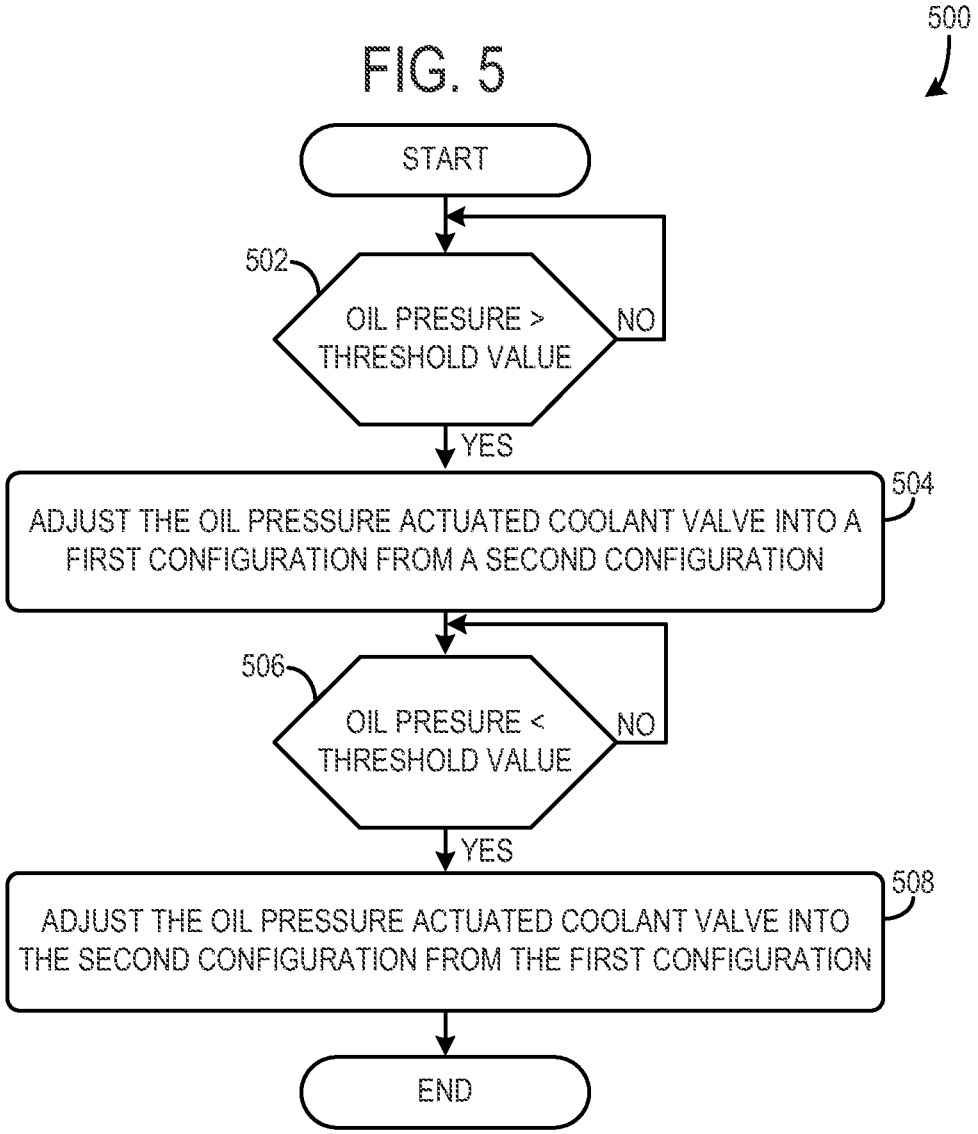
FIG. 5 shows another method for operation of an internal combustion engine.

FIG. 5 shows a method 500 for operation of an engine. Method 500 may be implemented to operate the engine 50 described above with regard to FIGS. 1-3 or may be implemented to operate another suitable engine.

At 502 it is determined if the oil pressure in a coolant valve control line is greater than a predetermined threshold value. If the oil pressure is not greater than the predetermined threshold value (NO at 502) the method returns to 502. However, if the oil pressure is greater than the predetermined threshold value (YES at 502) the method proceeds to 504 where the method including adjusting the oil pressure actuated coolant valve into a first configuration from a second configuration. As previously discussed, the first configuration may enable coolant flow in a cooling jacket in the engine and the second configuration may inhibit coolant flow in the coolant jacket. The cooling jacket may be positioned in a cylinder head and/or cylinder block. However in other embodiments, the first configuration may inhibit coolant flow in the coolant jacket and the second configuration may enable coolant flow in the cooling jacket. Thus, the first configuration is different from the second configuration.

At 506 it is determined if the oil pressure in the coolant valve control line is less than the predetermined threshold value. If it is determined that the oil pressure is not less than the predetermined threshold value (NO at 506) the method returns to 506. However, if it is determined that the oil pressure is less than the predetermined threshold value (YES at 506) the method proceeds to 508 where the method includes adjusting the oil pressure actuated coolant valve into the second configuration from the first configuration.

List of Reference Numerals

1 Oil circuit
2 Coolant circuit
2*a* Coolant line
3 Pump
3' Vane cell pump
4 Supply line
5 Lubricant receiving components
6 Oil pressure actuated coolant valve
7 Coolant valve control line
8 Filter
9 Oil cooler
10 Main oil gallery
10*a* Channel
11 Connecting rod bearing on crankshaft side
12 Main bearing on crankshaft side
13 Return line
14 Oil sump
15 Suction line
16 Pump valve
17 Engine control system
30 Bypass line
32 Pressure relief valve

40 Lubrication system
50 Engine
60 Liquid cooling system
80 Bypass line
200 Bypass valve
200 Rotor
202 Hollow cavity
206 Sliders
208 Pressure line
210 Second pressure line
212 Spring
216 Outlet
218 Inlet
300 Cylinder block
301 Cylinders
302 Cylinder head
303 Cooling jacket
304 Coolant passage
305 Outlet
306 Pump
308 Heat exchanger
310 Fan
320 Pistons
322 Cylinder liners
324 Crankshaft
326 Linkage
328 Generator
330 Main bearings
350 Vehicle

The invention claimed is:

1. An internal combustion engine comprising:

an oil circuit and a pump in fluidic communication with a supply line and at least one lubricant receiving component;

a filter and an oil cooler positioned in the supply line downstream of the pump; and a liquid cooling system including a coolant circuit having an oil pressure actuated coolant valve and a coolant valve control line in fluidic communication with the pump and having a first configuration in which coolant may flow therethrough and a second configuration in which coolant is inhibited from flowing therethrough, the first and second configurations triggered in response to a change in oil pressure in the coolant valve control line, wherein the coolant valve control line includes an inlet positioned in the supply line downstream of at least one of the filter and the oil cooler.

2. The internal combustion engine of claim 1, where the oil pressure actuated coolant valve adjusts from the first configuration into the second configuration when the oil pressure in the coolant valve control line decreases below a predetermined threshold value.

3. The internal combustion engine of claim 1, wherein the oil pressure actuated coolant valve adjusts from the second configuration to the first configuration when the oil pressure in the coolant valve control line increases above a predetermined threshold value.

4. The internal combustion engine of claim 1, where the oil pressure actuated coolant valve adjusts from the second configuration into the first configuration when the oil pressure in the coolant valve control line decreases below a predetermined threshold value.

5. The internal combustion engine of claim 1, where the pump is a vane cell pump including a rotor enclosed via a hollow cavity.

6. The internal combustion engine of claim 1, further comprising at least one cylinder head and at least one cylinder block which is connected to the at least one cylinder head and which receives a crankshaft in at least two main bearings, wherein the supply line discharges into a main oil gallery which is connected to the at least two main bearings and supplies said main bearings with oil.

7. The internal combustion engine of claim 6, where the coolant valve control line includes an inlet positioned in the main oil gallery.

8. The internal combustion engine of claim 6, wherein the cylinder block includes an upper crank housing and is coupled to an oil sump forming a lower crank housing and having engine oil stored therein and spaced away from the cylinder head, and where a suction line opening into the oil sump is in fluidic communication with the pump.

9. The internal combustion engine of claim 1, further comprising at least one cylinder head and a cooling jacket integrated into the cylinder head, the cooling jacket included in the coolant circuit.

10. A method for an engine, comprising:

adjusting oil pressure in an oil circuit, the oil circuit and a pump in fluidic communication with a supply line and at lest one lubricant receiving component, with a filter and an oil cooler positioned in the supply line downstream of the pump; and altering an oil pressure actuated coolant valve configuration in response to adjusting the oil pressure in the oil circuit, the oil pressure actuated coolant valve in fluidic communication with the oil circuit via a coolant valve control line and positioned in a coolant line in a coolant circuit in the engine, wherein the coolant valve control line includes an inlet positioned in the supply line downstream of at least one of the filter and the oil cooler.

11. The method of claim 10, where adjusting the oil pressure in an oil circuit includes adjusting a volumetric displacement of the pump.

12. The method of claim 10, where altering the configuration of the oil pressure actuated coolant valve includes adjusting the oil pressure actuated coolant valve into a first configuration from a second configuration, the first configuration enabling coolant flow in a coolant jacket in the engine and the second configuration inhibiting coolant flow in the coolant jacket.

13. The method of claim 12, where the oil pressure is increased above a predetermined threshold value to trigger coolant valve adjustment.

14. The method of claim 10, where altering the configuration of the oil pressure actuated coolant valve includes adjusting the oil pressure actuated coolant valve into a second configuration from a first configuration, the first configuration enabling coolant flow in a coolant jacket in the engine and the second configuration inhibiting coolant flow in the coolant jacket.

15. The method of claim 14, where the oil pressure is increased above a predetermined threshold value to trigger coolant valve adjustment.

16. The method of claim 10, where the oil pressure in the oil circuit is adjusted in response to a change in at least one of engine loading and engine speed.

17. An internal combustion engine comprising:

an oil circuit and a pump in fluidic communication with a supply line and at least one lubricant receiving component;

a liquid cooling system including a coolant circuit having an oil pressure actuated coolant valve and a coolant valve control line in fluidic communication with the pump and having a first configuration in which coolant may flow therethrough and a second configuration in which coolant is inhibited from flowing therethrough, the first and second configurations triggered in response to a change in oil pressure in the coolant valve control line; and at least one cylinder head and at least one cylinder block which is connected to the at least one cylinder head and which receives a crankshaft in at least two main bearings, wherein the supply line discharges into a main oil gallery which is connected to the at least two main bearings and supplies said main bearings with oil, wherein the coolant valve control line includes an inlet positioned in the main oil gallery.

* * * * *